United States Patent [19]

Maev et al.

[11] 4,160,640

[45] Jul. 10, 1979

[54] METHOD OF FUEL BURNING IN COMBUSTION CHAMBERS AND ANNULAR COMBUSTION CHAMBER FOR CARRYING SAME INTO EFFECT

[76] Inventors: Vladimir A. Maev, ulitsa Granitnaya, 36, kv. 46; Andrei L. Kuznetsov, ulitsa S. Kovalevskoi, 16/4, kv. 141; Jury A. Lamm, ulitsa S. Kovalevskoi, 16, kv. 79; Viktor V. Ivakhnenko, Tovarischesky prospekt, 4, kv. 373; Anatoly V. Sudarev, ulitsa Georgievskaya, 2, kv. 57; Nikolai N. Prokushenkov, ulitsa Babushkina, 8, kv. 177, all of Leningrad, U.S.S.R.

[21] Appl. No.: 829,152

[22] Filed: Aug. 30, 1977

[51] Int. Cl.[2] ..... F23M 3/00

[52] U.S. Cl. ..... 431/9; 431/183; 431/185

[58] Field of Search ..... 431/9, 185, 182, 183, 431/188, 187, 200, 164, 174, 176, 178, 179, 201

[56] References Cited

U.S. PATENT DOCUMENTS

| | | | |
|---|---|---|---|
| 1,817,911 | 8/1931 | Andrews et al. | 431/183 |
| 2,483,737 | 10/1949 | Parrish | 431/164 X |
| 2,548,656 | 4/1951 | Dolezal | 431/174 X |
| 2,755,750 | 7/1956 | Escher | 431/178 |
| 2,806,516 | 9/1957 | Brola | 431/174 X |
| 2,973,808 | 3/1961 | Fox, Jr. | 431/179 X |
| 3,030,773 | 4/1962 | Johnson | 431/9 X |
| 3,195,609 | 7/1965 | Nesbitt et al. | 431/9 |
| 3,237,677 | 3/1966 | Wiesenthal et al. | 431/175 X |
| 3,367,384 | 2/1968 | Voorheis | 431/9 |
| 3,576,388 | 4/1971 | Peczeli et al. | 431/182 |
| 3,700,376 | 10/1972 | Nipenberg | 431/188 X |
| 3,808,803 | 5/1974 | Salvi | 431/183 X |
| 3,852,020 | 12/1974 | Peczeli et al. | 431/9 |
| 3,993,449 | 11/1976 | Childs | 431/174 X |
| 4,018,554 | 4/1977 | Teodorescu et al. | 431/183 |
| 4,021,188 | 5/1977 | Yamagishi et al. | 431/9 X |
| 4,023,921 | 5/1977 | Anson | 431/9 |
| 4,095,929 | 6/1978 | McCartney | 431/175 |
| 4,123,220 | 10/1978 | Bond et al. | 431/175 X |

FOREIGN PATENT DOCUMENTS

| | | | |
|---|---|---|---|
| 2459974 | 7/1975 | Fed. Rep. of Germany | 431/9 |

*Primary Examiner*—James T. McCall

*Attorney, Agent, or Firm*—Robert E. Burns; Emmanuel J. Lobato; Bruce L. Adams

[57] ABSTRACT

The method of fuel burning in combustion chambers resides in predivision of the primary and secondary air into discrete coaxial annular streams, swirling of the coaxial annular streams of primary air tangentially about the longitudinal axis of the combustion chamber, the adjacent annular streams being swirled in opposite directions, admission of the swirled coaxial streams of primary air and a portion of the coaxial annular streams of secondary air simultaneously with fuel into the burning zone to form a recirculation flow of the fuel-air mixture, and delivery of the remaining portion of the coaxial annular streams of secondary air into the mixing zone of the combustion chamber. The annular combustion chamber carrying this method into effect comprises two concentric annular flame tubes for restriction of the burning zone, with an annular stabilizer disposed therebetween and having holes for fuel supply provided in the outer wall thereof. The stabilizer with the flame tubes define two concentric annular ducts with primary air supply members disposed therein and comprising a vane swirler and a slotted swirler with tangentially disposed slots, arranged in series in a downstream direction. The secondary air supply members are placed between the primary air supply members and the concentric annular flame tubes.

5 Claims, 14 Drawing Figures

METHOD OF FUEL BURNING IN COMBUSTION CHAMBERS AND ANNULAR COMBUSTION CHAMBER FOR CARRYING SAME INTO EFFECT

BACKGROUND OF THE INVENTION

1. Field of the Invention

The present invention relates to power, chemical, and transportation equipment engineering applications, and more particularly to methods of fuel burning in combustion chambers and to annular combustion chambers for carrying the methods into effect. The invention can find most utility when used in gas-turbine engines employing gaseous fuel such as natural gas, wherein the burning process is established on the separate fuel and air supply basis, and the fuel/primary air mixing and combustion stabilization are performed by using vortex flows.

2. Description of the Prior Art

A number of fuel-burning methods are known in the prior art, wherein in order that the flame may be stabilized, it is desirable to supply heat for ignition of the incoming air-fuel mixture to the base of the flame. In combustion chambers for gas-turbine engines, the average velocity of the fuel-air flow is invariably higher than that of turbulent combustion, so that the problems of igniting and sustaining combustion of the fuel, as well as the problems of providing a more complete fuel combustion and a specified gas flow temperature profile at the combustion chamber outlet are critical enough, since both an ineffective ignition and unstable combustion substantially reduce the operational reliability of the entire gas-turbine engine. The incomplete combustion of the fuel imposes a cost penalty on the engine, while the discrepancy between the actual temperature distribution of the gas flow proceeding at the outlet of the combustion chamber and the specified distribution results in a shorter life and poorer strength of the gas-turbine blades and hence of the entire engine.

Currently, problems pertaining to a higher furnace heat release per unit volume of the combustion chambers resulting in their shorter length and a better compactness, and attempts to reduce the content of deleterious components in the combustion products ejected to the atmosphere and to provide a reasonably low temperature level of the combustion chamber flame elements, become increasingly important.

A successful solution of these problems is largely dependent on the fuel-air mixing pattern in the burning zone of the combustion chamber and on providing stable hot gas recirculation zones therein, ensuring a reliable ignition of the fuel and sustained combustion under conditions of increased air excess in the burning zone.

A method of fuel burning is known in the art consisting in that the primary air flow, i.e., the air involved in generation and stabilization of the combustion process, is split into concentric annular streams, swirled at an angle of 45 to 60 degrees about the combustion chamber longitudinal axis, and introduced into the burning zone of the combustion chamber, the two concentric annular streams of the primary air separated by an annular stabilizer being swirled in opposite directions. Simultaneously, a fuel gas is supplied to the burning zone and mixed with the primary air to form a fuel-air mixture. In the air shadow zone, directly behind the stabilizer, a region of low pressure is produced, giving rise to a vertical recirculation flow in the burning zone, running along the combustion chamber axis, with the forward flow (downstream) of the burning fuel-air mixture and the reverse flow (upstream) of the hot combustion products. The products of combustion provide for heat supply to the incoming fuel-air stream and stabilizing the burning process. Also supplied to the mixing zone of the combustion chamber is the secondary air likewise previously divided into coaxial annular streams, which is added to the combustion products, thus reducing the temperature thereof and cooling the flame elements of the combustion chamber.

The annular combustion chamber carrying into effect this method of fuel burning, comprises two concentric annular flame tubes defining a portion of the combustion chamber burning zone and having an annular stabilizer arranged therebetween. The annular stabilizer subdivides the space between the flame tubes into two concentric annular ducts housing primary air supply members in the form of vane swirlers having angles of air swirling which are opposite in sign and providing swirling motion of the primary air annular streams in the concentric annular duct in opposite directions and admission thereof into the burning zone. The outer wall of the stabilizer, facing the burning zone, has holes provided therein for injection of the fuel into the burning zone. The secondary air supply members represent a vane swirler mounted on one of the flame tubes and displaced downstream from the primary air swirlers.

A serious disadvantage of the aforementioned method of fuel burning and of the combustion chamber carrying this method into effect resides in the reverse flow of combustion products effective in the burning zone. Such a recirculation flow pattern increases the length of the burning zone and prevents a more efficient use of the burning zone space, since a portion of its volume is taken up by the reverse flow of the combustion products, where in no combustion of the fuel-air mixture occurs.

In addition, the fuel combustion is performed with a low excess of air and, consequently, with a high temperature in the burning zone. This causes an increase in the content of deleterious constituents in combustion products ejected to the atmosphere, such as nitric exides. Furthermore, the high temperature in the burning zone gives rise to an increased heating of the fuel-delivery members of the combustion chamber, i.e., of the outer perforated wall of the stabilizer, thus resulting in a poorer serviceability of the chamber.

SUMMARY OF THE INVENTION

It is an object of the present invention to provide a method of burning fuel in combustion chambers and a combustion chamber for carrying the method into effect which would ensure a high intensity of the burning process and a shorter length of the burning zone by producing an intense vortex recirculation flow of the fuel-air mixture with the stream lines running across the combustion chamber.

Another object of the present invention is a reduced deleterious-constituent content of the combustion products objected to atmosphere.

A further object of the invention is an increased operational reliability of the combustion chamber due to a lower temperature of the fuel-delivery members of the combustion stabilizers.

With these and other objects in view, in a hereinproposed method of fuel burning in combustion chambers, residing in predivision of the primary and secondary air into discrete coaxial annular streams, swirling of the coaxial annular streams of primary air about the longitudinal axis of the combustion chamber, the adjacent streams being oppositely swirled, admission of the swirled coaxial annular streams of primary air together with the fuel into the burning zone of the combustion chamber to form a recirculation flow of the fuel-air mixture, according to the invention, a portion of the coaxial annular streams of the secondary air is introduced into the burning zone and the swirling of the coaxial annular streams of primary air is performed in a tangential direction.

With these and other objects in view, there is further proposed in an annular combustion chamber for carrying into effect this method of fuel-burning and comprising two concentric annular flame tubes for restriction of the burning zone, an annular stabilizer provided with holes in its outer wall for fuel admission and disposed between the concentric annular flame tubes to form two concentric annular ducts therewith, primary air supply members located in each of said ducts and including two vane swirlers having the angles of swirling, which are opposite in sign, and the secondary air supply members, wherein, according to the invention, the primary air supply members located in each of the two concentric annular ducts comprise a slotted swirler having a plurality of tangentionally disposed slots and arranged in series in a downstream direction with the vane swirler, the secondary air supply members being disposed between the primary air supply members and the concentric annular flame tubes.

One of the most desirable aspects of the proposed invention is that admission of the primary air to the burning zone in the form of tangentially swirled oppositely directed streams provides an intense recirculation flow in the burning zone, representing a plurality of intense large-scale vorticles that fill up the entire cross-sectional area of the burning zone and are free from the reverse flow of combustion products, thus appreciably minimizing the burning zone length and consequently, resulting in a shorter combustion chamber. The fact that the fuel-air mixture is carried forward along the path ensures its complete combustion within a shorter length of the combustion chamber. An intense heat- and mass-exchange, both intra- and inter-vertical, is extremely favourable to proper fuel-air mixing and ignition of the incoming fuel-air mixture, thereby intensifying the burning process.

Again, the injection of a portion of secondary air into the burning zone enables the burning process to be accomplished with a reduced temperature level in the burning zone, thus minimizing the heating of the flame elements of the combustion chamber, namely flame tubes, extending its life, and contributing to a lower nitric oxide content of the combustion products.

The secondary air supply members may be in the form of two annular slots defined by the concentric annular flame tubes and the primary air supply members each of the slots accommodating a vane swirler extending through at least a portion of the slot passage section, in each of the concentric annular ducts, the angle of swirling in the vane swirlers of the secondary air an supply members, being of the same sign as that of the slotted and vane swirlers of the primary air supply members.

The secondary air entering the burning zone as vertical streams will further assist in intensifying the process of combustion and cooling of the flame tubes.

It is advisable to provide inside the annular stabilizer a transverse partition with holes at least a portion of which is offset with respect to the holes in the outer wall of the stabilizer.

Such a constructional arrangement of the stabilizer tends to minimize heating of its outer wall which acts as a fuel-delivery member of the stabilizer. This is achieved by having the fuel streams proceeding out of the transverse partition holes impinge upon the outer wall of the stabilizer, thus providing a reliable cooling of the wall and an improved reliability of the combustion chamber.

The invention is further described with reference to and as illustrated in the accompanying drawings in which:

DETAILED DESCRIPTION OF THE INVENTION

Figure 1:
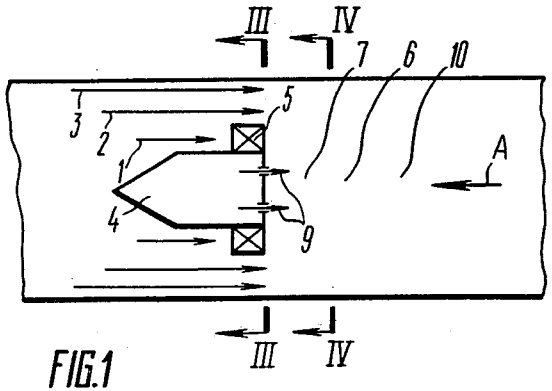
FIG. 1 is a schematic representation of air and fuel supply to the combustion chamber, according to the invention.
Figure 2:
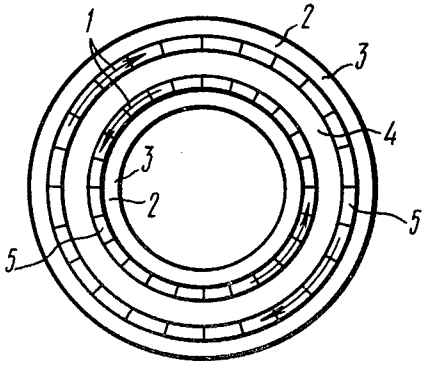
FIG. 2 is a schematic representation of admission of the coaxial annular air streams into the burning zone, according to the invention.
Figure 3:
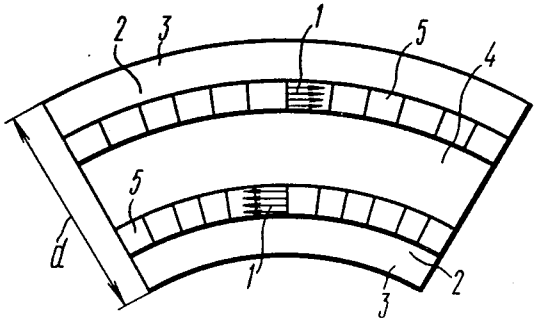
FIG. 3 is a sectional view taken along line III—III of FIG. 1.
Figure 4:
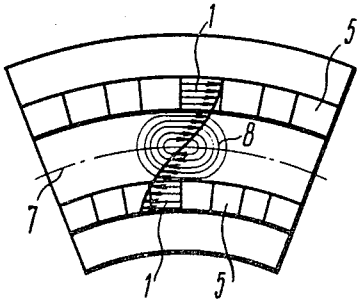
FIG. 4 is a sectional view taken along line IV—IV of FIG. 1.

According to the invention an airflow consisting of primary air providing combustion stabilization and secondary air ensuring a reduced temperature of the combustion products and a better cooling of the flame elements of the combustion chamber, prior to being introduced into the combustion chamber, is split into discrete coaxial annular streams 1, 2, 3 (FIG. 1) using a means, such as an annular stabilizer 4. The coaxial annular streams 1 (FIG. 1) of primary air are swirled by means of, say, swirlers 5 tangentially about the longitudinal axis of the combustion chamber and enter a burning zone 6 of the combustion chamber, the adjacent annular vertical streams 1 of primary air being oppositely directed as shown by arrows in FIG. 2. The velocity diagrams of the annular vertical streams 1 of primary air at the inlet of the zone 6 (FIG. 1) are shown in FIG. 3. As a result of interaction of the adjacent vertical streams 1 of primary air in an air shadow zone 7 (FIG. 1) disposed behind the stabilizer 4, a recirculation flow 8 (FIG. 4) is developed in the form of intense large-scale vorticies, the streamlines thereof being arranged transversely in the combustion chamber. Simultaneously, a fuel 9 is introduced into the zone 6 (FIG. 1). An intense turbulent exchange occurring both in a tangential and in a radial direction ensures the required heat supply to the incoming fuel-air mixture, resulting in a more stable and efficient burning process.

Also introduced into the burning zone 6 are the coaxial annular streams 2 of secondary air. As a result, the combustion of the fuel 9 and the process of partial mixing of combustion products and secondary air are essentially simultaneous, thus allowing combustion of the fuel 9 with a reduced temperature level in the burning zone 6 and, consequently, providing a decrease in contaminant-content of the combustion products.

Figure 5:
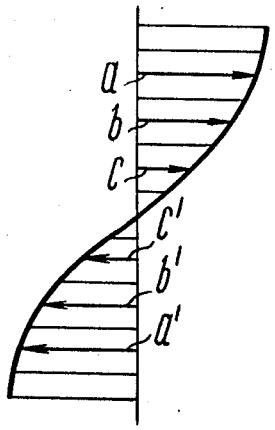
FIG. 5 shows velocity diagrams of interacting oppositely directed streams of air.
Figure 6:
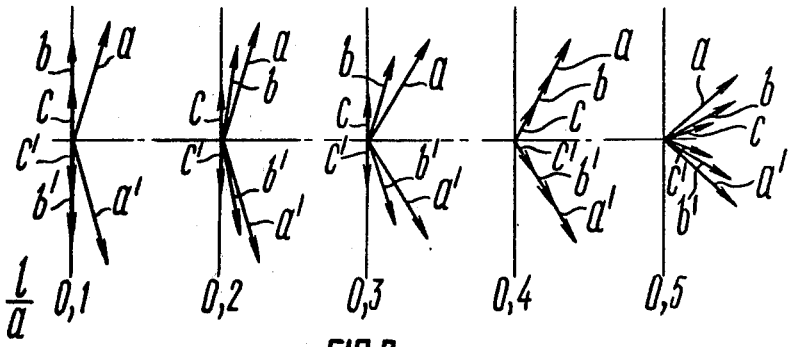
FIG. 6 shows velocity vectors of some of the stream lines in FIG. 5, disposed along the length of the combustion chamber.

FIG. 5 shows velocity vectors of some of the stream lines designated by a, b, c and a', b', c', of two interacting opposite directed annular streams 1 (FIG. 4) of primary air across the section of the burning zone 6 (FIG. 1), whereas FIG. 6 indicates a variation of the stream-line vectors over the length of the burning zone 6 (FIG. 1) obtained experimentally. In FIG. 6, 1/d ratios are plotted as abscissas, "1" being a distance along the burning zone axis and "d", a specific dimension of the burning zone. As it is seen from FIG. 6, the streamlines—0 of the fuel-air mixture are free from axial components in the reverse direction, thus considerably shortening the length of the burning zone 6 (FIG. 1).

The coaxial annular streams 3 of secondary air are introduced into a mixing zone 10 of the combustion chamber for further reduction of the combustion product temperature and for cooling of the flame elements of the combustion chamber.

Figure 7:
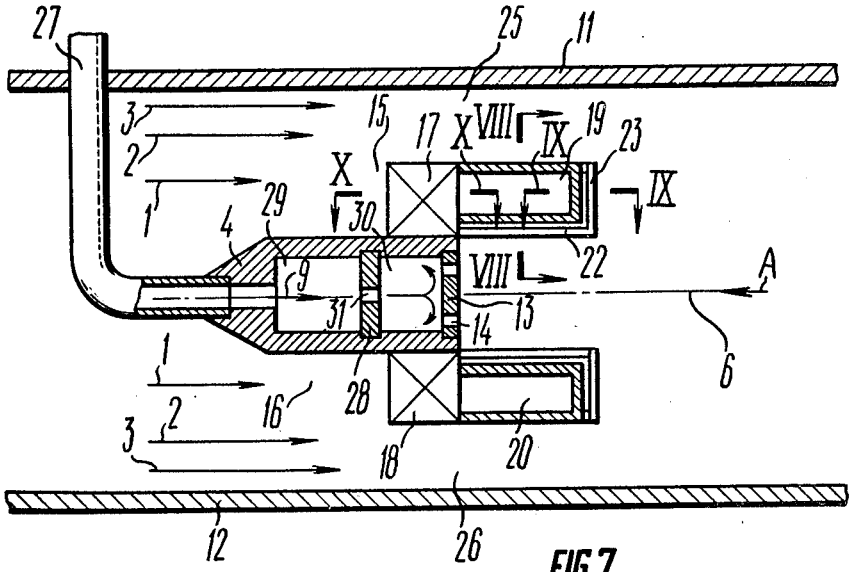
FIG. 7 is a longitudinal section through the annular combustion chamber, according to one of the embodiments of the invention.
Figure 8:
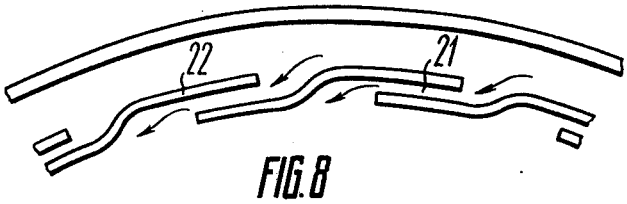
FIG. 8 is a sectional view taken along line VIII—VIII of FIG. 7.
Figure 10:
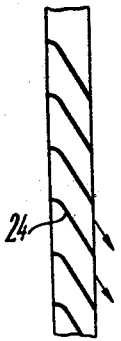
FIG. 10 is a sectional view taken along line X—X of FIG. 7.
Figure 9:
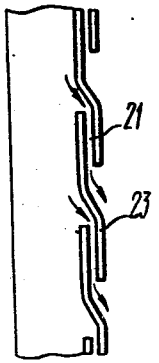
FIG. 9 is a sectional view taken along line IX—IX of FIG. 7.

The annular combustion chamber carrying into effect the proposed method of fuel burning, according to the invention, comprises two concentric annular tubes 11, 12 (FIG. 7) defining the burning zone 6, with the annular stabilizer 4 positioned therebetween. The outer wall 13 of the stabilizer 4, facing the burning zone, has holes 14 provided therein for injection of fuel into the burning zone 6 of the combustion chamber. The annular stabilizer 4 combines with the flame tubes 11, 12 to define concentric annular ducts 15, 16, wherein primary air supply members are disposed, including vane swirlers 17, 18 arranged in series in the downstream sense with angles of swirling of the airflow, being opposite in direction, and slotted swirlers 19, 20, respectively. The slotted swirler 19 is a hollow cylindrical ring with tangentially arranged slots 21 (FIG. 8) provided in a cylindrical wall 22 and in an end wall 23 thereof (FIG. 9) facing the burning zone 6 (FIG. 7), said slots extending in the same direction as vanes 24 (FIG. 10) of the vane swirler 17 (FIG. 7). The slotted swirler 20 is similar in construction with the swirler 19, except that its slots (not shown) are oriented in the same direction as the vanes (not shown) of the vane swirler 18.

The secondary air supply members are disposed intermediate of the primary air supply members and the annular flame tubes 11, 12 and take the shape of annular slots 25, 26 defined by the annular flame tubes 11, 12 and both the vane swirlers 17, 18 and the slotted wirlers 19, 20, respectively.

Figure 11:
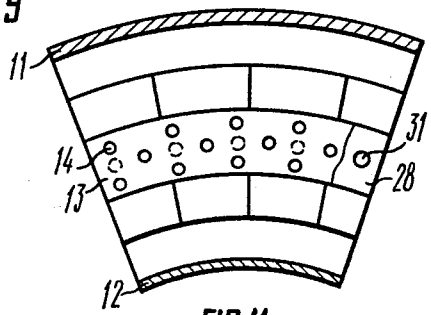
FIG. 11 is a view of the arrangement as soon along arrow A of FIG. 7.

The annular stabilizer 4 is essentially a hollow collector with fuel supply tubes 27 inserted into the internal cavity thereof. A transverse partition 28 placed inside the stabilizer 4 subdivides its internal cavity into two parts, the first part 29 being used for uniform fuel delivery around the circumference of the stabilizer 4, and the second part 30 serving to cool its outer wall 13. The partition 28 has holes 31 (FIG. 11), the axes of the holes 14 and 31 being misaligned, thus making possible a reliable cooling of the outer wall 13 of the stabilizer 4 (FIG. 7). It is also allowable to make a portion of the holes 31 (FIG. 11) coaxial with a portion of the holes 14 in the outer wall 13. This arrangement reads to a set of fuel streams at the outlet of the holes 31, the streams exhibiting different velocities and hitting ranges and providing a more stable combustion for light-duty operation.

Figure 12:
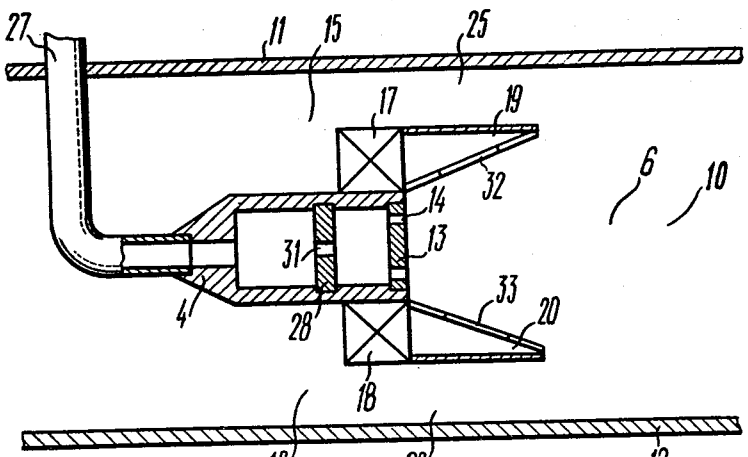
FIG. 12 is a longitudinal section view of an annular combustion chamber, according to another embodiment of the invention.

In the embodiment of the combustion chamber illustrated in FIG. 12, the slotted swirlers 19, 20 are in the form of hollow conical rings with tangentially arranged slots (not shown) on the conical walls 32, 33 thereof, facing the burning zone 6.

Figure 13:
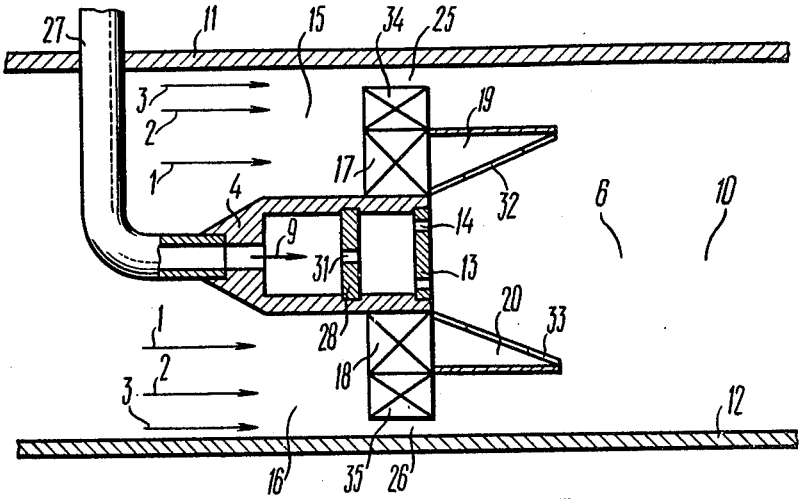
FIG. 13 is a longitudinal section view of an annular combustion chamber, according to a further embodiment of the invention.

FIG. 13 shows an embodiment of the annular combustion chamber, wherein the secondary air supply members comprise vane swirlers 34, 35 disposed alongside of the vane swirlers 17, 18 of the primary air within the annular slots 25, 26, respectively, and extending through a portion of the passage section of the latter. The angle of swirling of the airflow of the vane swirler 34 is of the same sign as that of the vane swirler 17. Similarly, the angles of swirling of airlow of the vane swirlers 35 and 18 are of the same sign.

Figure 14:
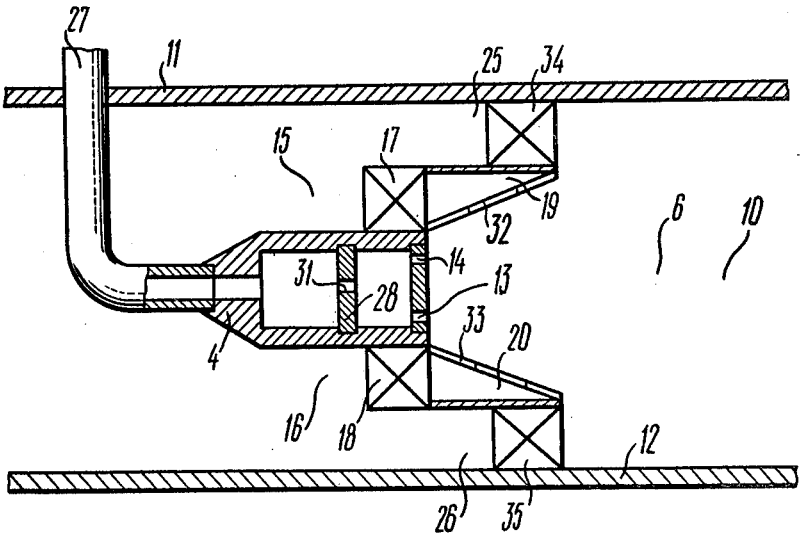
FIG. 14 is a longitudinal section view of an annular combustion chamber, according to still another embodiment of the invention.

In an embodiment of the combustion chamber illustrated in FIG. 14, the vane swirlers 34, 35 of secondary air are adapted to fully shut up the passage area of the annular slots 25, 26, respectively. It leads to an increased vorticity of the airflow delivered to the combustion chamber with the resultant intensification of both the fuel combustion and the mixing and cooling of the combustion chamber flame elements, i.e., the flame tubes 11, 12.

Principle of Operation

In operation, the airflow is divided in the annular ducts 15, 16 (FIG. 7) into the coaxial annular streams 1, 2, 3. The primary air 1 is tangentially swirled by the vane swirlers 17, 18 and the slotted swirlers 19, 20 and introduced into the burning zone 6, the swirling motions in the ducts 15, and 16 being oppositely directed. The direction of flow of the primary air 1 through the vane swirler 17 and the slotted swirler 19 is indicated by the arrows in FIGS. 8, 9, and 10. Also introduced into the burning zone 6 (FIG. 7) through the annular slots 25, 26 is the secondary air 2 which provides for a lower temperature of the combustion products and a better cooling of the annular flame tubes 11, 12. The fuel 9 is injected through the fuel-supply tubes 27 into the internal cavity of the stabilizer 4 and, through the holes 31 (FIG. 11) in the partition 28, it is carried forward in separate streams onto the inner surface of the outer wall 13 of the stabilizer 4 (FIG. 7) resulting in an effective cooling of the outer wall 13. Subsequently, the fuel 9 is introduced through the holes 14 in the outer wall 13 into the burning zone 6.

The proposed invention provides for burning of fuel in the minimum burning zone space of the combustion chamber permitting a substantial reduction in the size and weight of the combustion chamber and the overall gas-turbine engine. In addition, the combustion chamber is rendered more economical and reliable in operation. Further, the contaminant-content of the combustion products ejected into the environmental atmosphere is reduced.

Particular embodiments of the present invention have been disclosed hereinabove, but other modifications of the invention can be made which will remain within the concept and scope thereof, such as arrangements involving the use of converging and diverging radially directed annular streams, and also constructions, comprising two or more stabilizers.

What is claimed is:

1. A method of burning fuel in an annular combustion chamber, comprising predividing primary and secondary air into discrete coaxial annular streams;

swirling of said coaxial annular streams of primary air tangentially about a longitudinal axis of streams;

adjacent coaxial annular streams of primary air being swirled in opposite directions;

admitting the swirled coaxial annular streams of primary air and a portion of said coaxial annular streams of secondary air into a burning zone of an annular combustion chamber;

injecting fuel into said burning zone simultaneously with admission of said swirled coaxial annular streams of primary air and of said portion of the coaxial annular streams of secondary air to produce a recirculation flow of the fuel-air mixture; and admitting the remaining portion of said coaxial annular streams of secondary air to a mixing zone of said combustion chamber wherein products of combustion and secondary air are mixed;

whereby streamlines of said recirculation flow of the fuel-air mixture are developed transversely in said combustion chamber, thus developing a reduced temperature in said burning zone.

2. An annular combustion chamber comprising two concentric annular frame tubes defining a burning zone of the annular combustion chamber;

an annular stabilizer including a wall with holes for admission of fuel into the burning zone, said annular stabilizer being placed between said concentric annular flame tubes;

two concentric annular ducts defined by said concentric annular flame tubes and said annular stabilizer for division of airflow into discrete concentric annular streams;

primary air supply members disposed in each of said concentric annular ducts and comprising a vane swirler arranged in series in a downstream direction with a slotted swirler having a plurality of tangentially disposed slots;

the direction of swirling of said primary supply members in one of said concentric annular ducts, being opposite to that of said primary supply members in the other of said concentric annular ducts; and secondary air supply members disposed intermediate said concentric annular flame tubes and said primary air supply members.

3. An annular combustion chamber as disclosed in claim 2, wherein said secondary air supply members are in the shape of two annular slots defined by said concentric annular flame tubes and said secondary air supply members, and include two vane swirlers, each of them being disposed in one of said annular slots and extending through at least a portion of the passage area thereof, the angle of swirling in each of said vane swirlers of said secondary air supply members in one of said concentric annular ducts, being of the same direction as that of the primary supply members in the same concentric annular duct.

4. An annular combustion chamber as disclosed in claim 2, which further comprises a transverse partition with holes, placed within said annular stabilizer, at least part of said holes in said transverse partition being offset with respect to said holes in said outer wall of said annular stabilizer.

5. An annular combustion chamber as disclosed in claim 3, which further comprises a transverse partition with holes, disposed within said annular stabilizer, at least part of said holes in said transverse partition being offset relative to said holes in said outer wall of said annular stabilizer.

* * * * *